US005660059A

United States Patent [19]

Higginbotham

[11] Patent Number: 5,660,059

[45] Date of Patent: Aug. 26, 1997

[54] AIR SEPARATION

[75] Inventor: Paul Higginbotham, Guildford, England

[73] Assignee: The BOC Group plc, Windlesham Surrey, England

[21] Appl. No.: 674,294

[22] Filed: Jul. 1, 1996

[30] Foreign Application Priority Data

Jul. 6, 1995 [GB] United Kingdom ..... 9513766

[51] Int. Cl.[6] ..... F25J 3/04

[52] U.S. Cl. ..... 62/646; 62/940

[58] Field of Search ..... 62/644, 645, 646, 62/903, 905, 939, 940

[56] References Cited

U.S. PATENT DOCUMENTS

| | | | |
|---|---|---|---|
| 3,905,201 | 9/1975 | Conveney et al. | 62/940 X |
| 5,237,822 | 8/1993 | Rathbone | 62/646 |
| 5,275,003 | 1/1994 | Agrawal et al. | 62/646 |
| 5,386,692 | 2/1995 | Laforce | 62/646 |
| 5,402,646 | 4/1995 | Rathbone | 62/646 |
| 5,438,835 | 8/1995 | Rathbone | 62/646 |
| 5,454,227 | 10/1995 | Straub et al. | 62/646 |
| 5,511,381 | 4/1996 | Higgenbotham | 62/646 |
| 5,515,687 | 5/1996 | Arriulou | 62/646 |
| 5,546,766 | 8/1996 | Higgenbotham | 62/645 |

*Primary Examiner*—Christopher Kilner
*Attorney, Agent, or Firm*—David M. Rosenblum; Salvatore P. Pace

[57] ABSTRACT

An air separation plant and process in which a first stream of compressed feed air is introduced in vapour state into a higher pressure rectification column and separated therein into nitrogen vapour and oxygen-enriched liquid air and a flow of the nitrogen vapour is condensed in condenser-reboiler. A flow of the oxygen-enriched liquid air is separated in a reboiled lower pressure rectification column into nitrogen-rich and oxygen-rich fractions. A first flow of the condensed nitrogen is employed as reflux in the higher pressure rectification column and a second flow of the condensed nitrogen is employed as reflux in the lower pressure rectification column. A flow of compressed feed air is expanded in expansion turbine with the performance of external work so as to create refrigeration for the process. Products of the separation include one or both of a gaseous nitrogen product taken from the higher pressure rectification column and a liquid nitrogen product. A second stream of compressed feed air is liquefied. At least a part of the liquefied second air stream is vaporised in vaporiser at a pressure less than that at the top of the higher pressure rectification column by indirect heat exchange with a part of the said flow of nitrogen vapour, and the resulting vaporised air is warmed, is recompressed, and is mixed with feed air upstream of a location from where the first stream is taken.

19 Claims, 1 Drawing Sheet

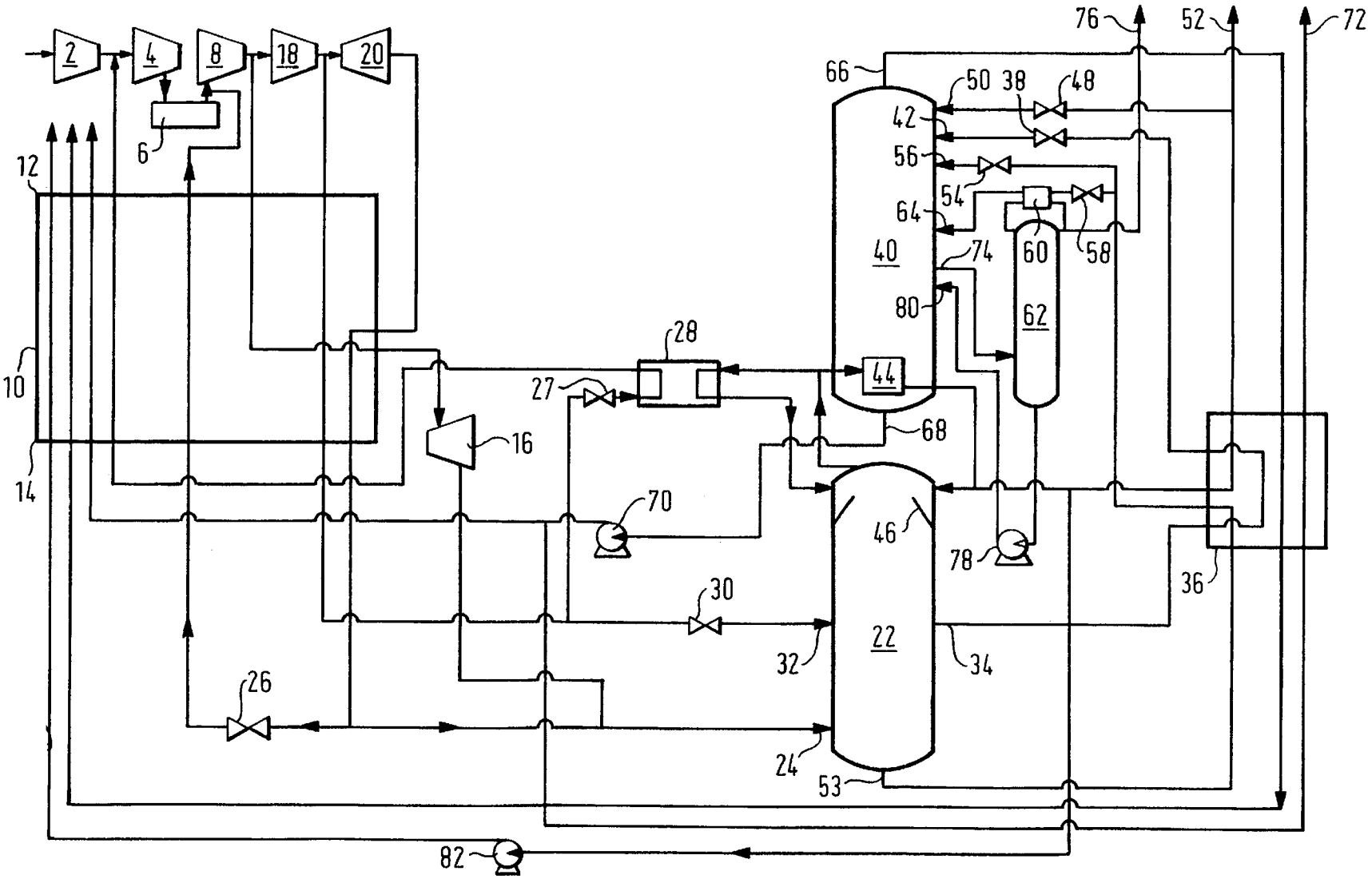
72
52
76
48
38
50
42
56
64
54
74
58
60
62
80
40
44
66
68
36
78
34
46
22
53
32
24
30
28
27
70
16
82
20
18
8
4
2
6
26
12
10
14

AIR SEPARATION

BACKGROUND OF THE INVENTION

This invention relates to a process and plant for separating air.

The most important method commercially for separating air is by rectification. In such a method there are typically performed steps of compressing and purifying the air, fractionating the compressed, purified, air in the higher pressure column of a double rectification column comprising a lower pressure rectification column in addition to the higher pressure one; condensing, by indirect heat exchange with oxygen-rich fluid separated in the lower pressure column, nitrogen vapour separated in the higher pressure rectification column; employing a first stream of the resulting condensate as reflux in the higher pressure rectification column and a second stream of the resulting condensate as reflux in the lower pressure rectification column; withdrawing an oxygen-enriched liquid air stream from the higher pressure rectification column; introducing an oxygen-enriched vaporous air stream into the lower pressure rectification column, and separating the oxygen-enriched vaporous air stream therein into oxygen-rich and nitrogen-rich fractions.

Purification of the air is performed so as to remove impurities of relatively low volatility, particularly water vapour and carbon dioxide. If desired, hydrocarbons may also be removed.

In order to meet the refrigeration requirements of the air separation plant, a stream of pressurised fluid, typically either air or nitrogen, is expanded in an expansion turbine with the performance of external work. Oxygen-rich and nitrogen-rich products may be taken from the lower pressure rectification column in vapour state or liquid state, or both states. In addition, an argon-enriched oxygen stream may be withdrawn from a region of the lower pressure rectification column where the argon concentration is in the order of 10 times greater than in the incoming air and separated in a further rectification column to produce an impure or pure argon product.

In order to maintain an energy balance within the arrangement of columns, it is generally necessary to employ a net flow rate of liquid into the columns equal to the net rate at which liquid products are withdrawn therefrom. Thus, as a greater proportion of the products of the air separation are taken in liquid state from the columns, so a greater proportion of the air needs to be introduced into the arrangement of columns in liquid state. In practice, the majority of such liquid air is typically introduced into the higher pressure rectification column. The result is that the proportion of air entering the higher pressure rectification column in vapour state is reduced, and therefore less nitrogen is separated from the air in the higher pressure rectification column. For each unit of liquid nitrogen taken as product, the nitrogen separated in the higher pressure rectification column is reduced by about 0.4 units. The reflux to the lower pressure rectification column is therefore reduced by about 1.4 units (the one unit of extra liquid nitrogen product and the 0.4 units reduction in the nitrogen separated in the higher pressure rectification column). A reduction in the supply of reflux to the lower pressure rectification column also takes place if a vaporous nitrogen product is taken directly from the higher pressure rectification column.

The reduction in reflux in the lower pressure rectification column causes there to be a reduction in the yield or recovery of oxygen. If an argon product is separated, there is also a reduction in the yield or recovery of argon. The reduction in argon recovery tends to become more marked than that in the oxygen recovery as, for example, liquid nitrogen production is increased. In practice, there is therefore a ceiling placed on the proportion of the products of the air separation and particularly, for example, the proportion of liquid nitrogen that can be taken from the rectification columns in liquid state while still obtaining satisfactory yields of argon and/or oxygen. It is an aim of the present invention to provide a process and plant which enable the ceiling to be raised.

SUMMARY OF THE INVENTION

According to the present invention there is provided an air separation process in which a first stream of compressed feed air is introduced in vapour state into a higher pressure rectification column and separated therein into nitrogen vapour and oxygen-enriched liquid air, a flow of the nitrogen vapour is condensed, a flow of the oxygen-enriched liquid air is separated in a reboiled lower pressure rectification column into nitrogen-rich and oxygen-rich fractions, a first flow of the condensed nitrogen is employed as reflux in the higher pressure rectification column, a second flow of the condensed nitrogen is employed as reflux in a lower pressure rectification column, a flow of compressed feed air is expanded with the performance of external work so as to create refrigeration for the process, products of the separation include one or both of a gaseous nitrogen product taken from the higher pressure rectification column and a liquid nitrogen product, and a second stream of compressed feed air is liquefied, characterised in that at least a part of the liquefied second air stream is vaporised at a pressure less than that at the top of the higher pressure rectification column by indirect heat exchange with a part of the said flow of nitrogen vapour, and the resulting vaporised air is warmed, is recompressed and is mixed with feed air upstream of a location from which the first stream is taken.

The invention also provides an air separation plant comprising a plurality of compression stages for compressing an air feed, a higher pressure rectification column for separating air into nitrogen vapour and oxygen-enriched liquid air, a first inlet for a first stream of compressed feed air in vapour state to the higher pressure rectification column, a condenser associated with the higher pressure rectification column for condensing a flow of said nitrogen vapour, a second inlet to the higher pressure rectification column for a reflux flow of part of the condensed nitrogen vapour, an outlet from the higher pressure rectification column for a flow of the oxygen-enriched liquid air, a lower pressure rectification column for separating the oxygen-enriched liquid air into nitrogen-rich and oxygen-rich fractions, a first inlet to the lower pressure rectification column in communication with said outlet from the higher pressure rectification column, a second inlet to the lower pressure rectification column for a reflux flow of another part of the condensed nitrogen vapour, a reboiler associated with the lower pressure rectification column, outlets from the plant for oxygen and nitrogen products including one or both of an outlet for a liquid nitrogen product and an outlet, from the higher pressure rectification, for a vaporous nitrogen product, at least one expansion turbine for expanding compressed air with the performance of external work, means for liquefying a second stream of compressed air, characterised in that the plant additionally includes a vaporiser for vaporising at least a part of the liquefied second air stream at a pressure less than the pressure at the top of the higher pressure rectification column by indirect heat exchange with a part of the said flow of nitrogen vapour, and a heat exchanger for warming the resulting vaporised air, and in that one of the said compression stages has an inlet communicating with an outlet from said heat exchanger for the warmed, vaporised air or there is a dedicated compressor for recompressing the warmed, vaporised air which has an inlet communicating with the outlet from said heat exchanger for warmed, vaporised air and which has an outlet communicating with one of said compression stages.

The plant and process according to the invention enable a given demand for liquid nitrogen condensate to be met with a lower rate of introduction of liquid air into the rectification column than would be possible in conventional processes and plant. As a result, the ceiling on the proportion of the oxygen and nitrogen products that may be taken in liquid state and/or, in the case of nitrogen, as vapour from the higher pressure rectification column may be increased for a given oxygen recovery (or in the event that it is separated as a product) a given argon recovery. Further, unless the dedicated compressor is used, no additional compression machinery is required; such additional compression machinery would however be required were the demand for liquid nitrogen to be met in part by taking a stream of nitrogen vapour from the lower pressure rectification column, recompressing it and cooling and condensing the recompressed nitrogen.

By the term "rectification column", as used herein, is meant a distillation or fractionation column, zone or zones, i.e. a contacting column, zone or zones wherein liquid and vapour phases are countercurrently contacted to effect separation of a fluid mixture, as for example, by contacting the vapour and liquid phases on packing elements or on a series of vertically spaced trays or plates mounted within the column, zone or zones. A rectification column may comprise a plurality of zones in separate vessels if, for example, in the event all the trays, plates or packing were contained within a single vessel, the resulting height of the rectification column would be undesirably great. For example, it is known to include a height of packing amounting to approximately 200 theoretical plates in an argon rectification column. If all this packing were included in a single vessel, the vessel may typically have a height of over 50 metres. It is therefore desirable to construct the argon rectification column in two separate vessels so as to avoid having to employ a single, exceptionally tall, vessel.

The warmed vaporised air is preferably mixed with a flow of feed air upstream of its being recompressed. Alternatively, the dedicated compressor for compressing the warmed vaporised air upstream of its mixing with the air feed may be employed.

It is generally preferred to introduce a further liquefied air stream into one or both of the higher pressure rectification column and the lower pressure rectification column. Such introduction of liquefied air into the higher and/or lower pressure rectification columns facilitates the achievement of higher recoveries of products of given purity than would otherwise be possible.

The first stream of compressed air is preferably formed at least in part of the flow of expanded feed air. Accordingly, the first inlet to the higher pressure rectification column preferably communicates with an outlet of the said expansion turbine.

Preferably a part of the flow of the expanded feed air is warmed, is mixed with incoming compressed air feed and is recompressed therewith.

In examples of a plant according to the invention in which the outlet of the said expansion turbine communicates with both the first inlet to the higher pressure rectification column and an inlet to one of the compression stages, the plant preferably additionally includes means (for example a valve) for determining the proportions of turbine expanded air that, in use, are respectively introduced into the higher pressure rectification column through its first inlet and returned to said one of the compression stages.

The incoming air feed is preferably subjected to the first and second stages of compression upstream of being purified, and to at least one further stage of compression downstream of being purified, wherein the warmed, vaporised part of the second air stream is mixed with the incoming air feed intermediate the first and second stages of compression, and the part of the flow of the expanded feed air that is warmed is mixed with the incoming air feed downstream of its purification. Thus, the outlet from the said heat exchanger for the warmed, vaporised air flow preferably communicates with an inlet to the second compression stage, and the outlet from the said heat exchanger for the turbine expanded air preferably communicates with the said further compression stage. An advantage of this arrangement is that the compression stages may be arranged such that the air purifier can be operated at a conventional pressure in the order of 6 bar. Other arrangements are possible. For example, the air purifier may be operated at approximately the pressure at which the said part of the air flow is vaporised. However, such an arrangement will require larger purification vessels in view of the lower purification pressure.

The second stream of compressed air is preferably taken from the most downstream of the compression stages. In some examples of the process and plant according to the invention, it is desirable to produce an elevated pressure oxygen product by withdrawing oxygen-rich fraction in liquid state from the lower pressure rectification, pressurising the fraction, and vaporising the resulting pressurised oxygen-rich stream typically by indirect heat exchange with incoming compressed air. Alternatively, or in addition, a liquid nitrogen product may be taken from the higher pressure rectification column, pressurised and vaporised by indirect heat exchange with the incoming air. In such examples, the pressure at which the high pressure nitrogen or oxygen stream is required effectively determines the outlet pressure of the most downstream of the compression stages. Typically, this outlet pressure is about twice that at which the high pressure oxygen is required.

Preferably, the said resulting vaporised air is warmed by indirect heat exchange with air flowing to the rectification column.

The plant and process according to the invention are particularly suitable for use when an argon-enriched oxygen stream is withdrawn from the lower pressure rectification column and has an argon product separated therefrom in a further rectification column.

Typically, the lower pressure rectification column is reboiled by part of the said flow of nitrogen vapour. Accordingly, the condenser associated with the higher pressure rectification column and the reboiler associated with the lower pressure rectification column form a single unit in which the oxygen rich fraction is reboiled by indirect heat exchange with condensing nitrogen vapour.

BRIEF DESCRIPTION OF THE DRAWINGS

An air separation process and plant according to the present invention will now be described by way of example with reference to the accompanying drawing which is a schematic flow diagram of an air separation plant.

The drawing is not to scale.

DETAILED DESCRIPTION

Referring to the drawing, an incoming air stream is compressed in first and second successive compression stages 2 and 4 respectively. The stages 2 and 4 typically form part of a single machine or may alternatively be provided by separate compressors. The compressed incoming air flows out of the compressor stage 4 to an air purification unit 6. The purification unit 6 is effective to remove water vapour, carbon dioxide and other adsorbable impurities of low volatility from the air with the result that the purified air consists essentially of a mixture of oxygen, nitrogen and argon. The purification unit 6 employs beds (not shown) of adsorbent to effect the removal of water vapour, carbon dioxide and other impurities. The beds are operated out of sequence with one another such that while one or more beds are purifying the compressed air flow, the remainder are able to be regenerated, for example, by being purged by a stream of hot nitrogen. Such purification units and their operation are well known in the art and need not be described further.

The resulting purified air flows into a third compression stage 8 and is further compressed therein. The compression stage 8 may form part of the same machine as the compression stages 2 and 4 or alternatively may be a separate compressor. One stream of resulting, further compressed, air flows from the outlet of the compression stage 8 to a main heat exchanger 10 having a warm end 12 and a cold end 14. This flow of further compressed air enters the main heat exchanger 10 through its warm end 12 and is cooled by passage therethrough. The thus cooled stream of first compressed air is withdrawn from the main heat exchanger 10 at an intermediate region thereof, and at an intermediate temperature in the order of 150 to 170K, and is expanded with the performance of external work in a first expansion turbine 16.

The remainder of the further compressed air that leaves the compression stage 8 is compressed yet again in a fourth compression stage 18. One part of the resulting, yet further compressed, air is expanded with a performance of external work in a second expansion turbine 20. The resulting stream of expanded air is introduced into the main heat exchanger 10 at an intermediate region thereof and flows to the cold end 14 of the heat exchanger 10. This air stream leaves the cold end 14 of the main heat exchanger at approximately its dew point.

The first and second expansion turbines 16 and 20 have similar outlet pressures such that the stream leaving the second expansion turbine 20, downstream of its cooling in the main heat exchanger 10, has the same pressure as the flow of air that leaves the first expansion turbine 16. This pressure is essentially equal to that at the bottom of a higher pressure rectification column 22. Downstream of its exit from the cold end 14 of the main heat exchanger 10 the flow of expanded air from the second expansion turbine 20 is merged with the flow of expanded air from the first expansion turbine 16. The resulting mixed flow is divided into two parts. One part is introduced into the bottom region of the higher pressure rectification column 22 through an inlet 24. The other part is returned through the main heat exchanger 10 from its cold end 14 to its warm end 12 and is mixed with the purified air intermediate the purification unit 6 and the third compression stage 8. A flow control valve 26 may be set so as to give a desired proportionation of the flow between the rectification column 22 and the compression stage 8.

The remainder of the yet further compressed air that leaves the fourth compression stage 18 (i.e. that part which is not passed to the second expansion turbine 20) is cooled by passage through the main heat exchanger 10 from its warm end 12 to its cold end 14. The thus cooled air stream leaves the cold end 14 of the heat exchanger either in liquid state or as a supercritical fluid depending upon the outlet pressure of the fourth compression stage 18. The liquefied or supercritical stream is divided into second and third air streams. The second air stream flows through an expansion device 27 in the form of a Joule-Thomson valve. Passage of the stream through the valve 27 reduces its pressure to below that at the top of the higher pressure rectification column 22. If the stream enters the valve 27 as a supercritical fluid, it leaves the valve 27 in mainly liquid state. The second air stream in liquid state (but also containing some vapour as a result of the formation of flash gas by passage through the valve 27) flows into a vaporiser 28 and is vaporised by indirect heat exchange. The resulting vapour stream is warmed to approximately ambient temperature by passage through the heat exchanger 10 from its cold end 14 to its warm end 12 and is introduced into the inlet of the second compression stage 4.

The third air stream is passed through an expansion device 30 in the form of another Joule-Thomson valve. The stream leaves the valve 30 at approximately the operating pressure of the higher pressure rectification column 22. Accordingly, if the stream was in supercritical state at the inlet to the valve 30, it leaves the valve 30 as liquid. A liquid stream (typically also containing some flash gas) passes from the valve 30 into the higher pressure rectification column 22 through an inlet 32 located above the inlet 24. A flow of liquid air is withdrawn from the higher pressure rectification column 22 through an outlet 34 situated at the same level as the inlet 32. The rate of withdrawal of this liquid air is typically less than that at which liquid air flows into the column 22 through the inlet 32. The liquid air withdrawn through the inlet 34 is sub-cooled by passage through part of the extent of a heat exchanger 36, is expanded through a pressure reducing or Joule-Thomson valve 38 and is introduced into a lower pressure rectification column 40 through an inlet 42. There are various alternatives (that are not shown in the drawing) to the withdrawal of the liquid air stream through the outlet 34 of the higher pressure rectification column 22. One alternative is to take a part of the third air stream either from upstream or downstream of the Joule-Thomson valve 30 and sub-cool this part in the heat exchanger and introduce it into the lower pressure rectification column 40 via a further expansion valve (not shown). Another alternative is to take such a liquid air stream from upstream or downstream of the Joule-Thomson valve 27.

The air introduced into the higher pressure rectification column 22 is separated therein into nitrogen vapour and oxygen-enriched liquid air. The separation is effected by intimate contact of an ascending vapour phase with a descending liquid phase. The contact takes place on liquid-vapour contact devices (not shown) within the higher pressure rectification column 22 which can take the form of distillation trays or plates or random or structured packing. Intimate contact between ascending vapour and descending liquid results in mass transfer taking place between the two phases. The liquid phase becomes progressively richer as it descends the column in the least volatile component of air (i.e. oxygen) and the vapour phase becomes progressively richer in the most volatile component (i.e. nitrogen). A downward flow of liquid reflux through the column 22 is created by condensing nitrogen vapour taken from the top of the higher pressure rectification column 22 and returning a part of the resulting condensate to the column 22. A part of the condensate is formed by condensing a first flow of nitrogen withdrawn from a higher pressure rectification column 22 in a condenser-reboiler 44. Another part of the nitrogen condensate is formed by condensing a second flow of nitrogen from the top of the higher pressure rectification column 22 in the vaporiser 28. By this means, the heating necessary for the vaporisation of the second air stream is provided. The flows of condensed liquid nitrogen are returned to a liquid nitrogen collector 46 located at a top region of the column 22. A part of the liquid nitrogen is utilised in the higher pressure rectification column 22 as reflux, as aforesaid. The remainder is withdrawn therefrom and is sub-cooled by passage through a part of the extent of the heat exchanger 36. The resulting sub-cooled liquid nitrogen stream is divided into two parts. One part is reduced in pressure by passage through a Joule-Thomson or pressure reducing valve 48 and is introduced into a top region of the lower pressure rectification column 40 through an inlet 50. The second part of the sub-cooled liquid nitrogen stream is taken as product via an outlet 52 from the plant.

A stream of oxygen-enriched liquid air is withdrawn from the bottom of the higher pressure rectification column 22 through an outlet 53, is sub-cooled by passage through a part of the extent of the heat exchanger 36 and is divided into two subsidiary streams. One subsidiary stream of sub-cooled oxygen-enriched liquid air is passed through a pressure reduction or Joule-Thomson valve 54 and is introduced into the lower pressure rectification column 40 through an inlet 56 below the level of the inlet 50. The other part of the sub-cooled stream of oxygen-rich liquid air is passed through another pressure reduction or Joule-Thomson valve 58 and is vaporised by passage through a condenser 60 which is associated with the top of a further rectification column 62 in which an argon product is separated. The vaporised oxygen-enriched air stream passes from the condenser 60 into the lower pressure rectification column 40 via an inlet 64 at a level below that of the inlet 56.

The air streams that are introduced into the lower pressure rectification column are separated therein into oxygen-rich and nitrogen-rich fractions. The nitrogen-rich fraction typically is more than 99.9% pure. The oxygen-rich fraction typically has purity of 99.7% or higher. The separation that occurs in the column 40 is effected by intimate contact of an ascending vapour stream with a descending liquid stream. The ascending vapour stream is formed in the condenser-reboiler 44 by heat exchange of condensing nitrogen with a part of the liquid fraction at the bottom of the rectification column 40, the liquid thereby being reboiled. The descending liquid stream is created by virtue of the introduction of liquid nitrogen into the top region of the lower pressure rectification column 40 through the inlet 50. The contact is effected on liquid-vapour contact devices which can either take the form of distillation trays or plates or of packing (either random packing or structured packing). The vapour phase generally becomes progressively richer in nitrogen as it ascends the rectification column 40 while the liquid phase becomes generally progressively richer in oxygen as it descends the column 40. A nitrogen vapour stream is withdrawn from the top of the lower pressure rectification column 40 through an outlet 66 and flows through the heat exchanger 36 from its cold end to its warm end, thus providing refrigeration for this heat exchanger 36. The thus warmed stream of nitrogen flows from the heat exchanger 36 through the main heat exchanger 10 from its cold end 14 to its warm end 12 and leaves the warm end at approximately ambient temperature. Some of this nitrogen may if desired be used for the purpose of regenerating adsorbent beds in the purifier 6. A liquid oxygen product is withdrawn from the bottom of the lower pressure rectification column 40 through an outlet 68 by means of a pump 70 whose operation raises the pressure of the liquid oxygen stream. A part of the pressurised liquid oxygen stream flows through the main heat exchanger 10 from its cold end 14 to its warm end 12 and is thereby vaporised. A high pressure gaseous oxygen product is thereby formed. Another part of the pressurised liquid oxygen flows from the pump 70 through the heat exchanger 36 from its warm end to its cold end and is thereby sub-cooled. The resulting sub-cooled liquid oxygen stream is withdrawn from the plant through an outlet 72.

There occur at an intermediate region within the lower pressure rectification column 40 argon concentrations that are substantially greater than that of the incoming air. An argon-enriched oxygen stream, typically containing about 10% by volume of argon, is withdrawn from the intermediate region through an outlet 74 and is introduced into the further rectification column 62. The further rectification column separates an argon product from the argon-enriched oxygen vapour stream. The separation is carried out as in the other rectification columns by intimately contacting an ascending vapour stream with a descending liquid stream. The descending liquid stream is created by condensation of vapour taken from the top of the further rectification column 62 in the condenser 60. A part of the resulting condensate is returned as reflux to the column 62 while the remainder is withdrawn from the plant as product argon through an outlet 76. Structured or random packing (not shown) is typically used in the rectification column 62 in order to effect contact between the liquid and vapour phases. If a sufficient height of packing is employed in the rectification column 62 essentially oxygen-free argon can be obtained in the manner described in EP-A-0 377 117. In this event, the rectification column 62 will be substantially taller than the column 40 and a pump 78 is typically operated in order to return oxygen-rich liquid from the bottom of the rectification column 62 to the lower pressure rectification column 40 via an inlet 80 at essentially the same level as that of the outlet 74.

Various other products in addition to those described above may be taken from the plant shown in the accompanying drawings. For example, a part of the nitrogen condensate withdrawn from the top of the higher pressure rectification column 22 may be pressurised by a pump 82 and vaporised by passage through the main heat exchanger 10 from its cold end 14 to its warm end 12. In other examples, a medium pressure nitrogen product may be formed by taking a stream (not shown) of the nitrogen vapour separated in the higher pressure rectification column 22, and warming it by passage through the heat exchanger 10.

Although not shown in the accompanying drawing, each of the compression stages 2, 4, 8 and 18 has associated with its outlet a water cooler so as to remove heat of compression therefrom. Further, the compression stages 18 and 8 are preferably provided by separate booster-compressors which may be coupled to the first and second expansion turbine 16 and 20 in order that the work performed by expansion can be used in driving the respective booster-compressors.

In a typical example of the operation of the plant described with reference to the accompanying drawing, the first compression stage 2 is operated with an outlet pressure in the order of 4 bar, the second compression stage 4 with an outlet pressure in the order of 6 bar, the third compression stage 8 with an outlet pressure in the order of 30 bar and the fourth compression stage 18 with an outlet pressure in the order of 60 bar. Further, in this example, the top of the higher pressure rectification column is typically of a pressure of 5.8 bar, the top of the lower pressure rectification column is operated at about 1.3 bar, and the top of the further rectification column 62 at a pressure of about 1.1 bar. Further, in this example, the second air stream is vaporised in the vaporiser 28 at pressure in the order of 4 bar.

In the plant shown in the accompanying drawing the recycle of the air to the third compression stage 8 enables a greater amount of liquid air to be formed than would otherwise be possible. Accordingly, a greater proportion of the nitrogen product may be taken in liquid state through the outlet 52 and/or by means of the pump 82. If all of the liquid air is introduced into the column system and none of it employed to condense nitrogen vapour in the vaporiser 28, and if there were no recycle to the compression stage 8, the total rate of production of liquid products would be no more than about 15% and the rate of production of liquid nitrogen would be no more than about 5% of the rate of flow of purified air into the process, if an argon recovery of 80% and an oxygen recovery of 99% are to be achieved. If a recycle to the compression stage 8 were added, the relative rate of production of oxygen in liquid would be increased, but the rate of production of liquid nitrogen would still not exceed 5%.

The proportion of nitrogen product taken in liquid state can be increased by the process according to the invention by condensing extra nitrogen from the higher pressure rectification column 22 in the vaporiser 28. In order to provide the additional nitrogen vapour for condensation in the vaporiser 28, the rate at which air vapour is fed to the higher pressure rectification column 22 through the inlet 24 is increased, thereby reducing the rate at which nitrogen is recycled to the third compression stage 6. In view of this decrease, the need to recycle the vaporised air from the vaporiser 28 to the second compression stage 4 does not increase the total recycle flow. In essence, therefore, a part of the air is now recycled at about 4 bar instead of about 6 bar. In one example of operation of the plant shown in the drawing it is possible to produce all the oxygen product in liquid state and to take a liquid nitrogen product at a rate of 15% of the rate at which air flows into the process, while obtaining an oxygen recovery of 99% and an argon recovery of 80%.

If desired, instead of recycling the vaporised air from the vaporiser 28 to the second compression stage 4, this recycle stream may downstream of its passage through the heat exchanger 10 be compressed in a further compressor (not shown) and mixed with the flow of expanded air being returned to the third compression stage. This alternative is, however, not generally preferred because it requires an additional compressor.

I claim:

1. An air separation process comprising:

introducing a first stream of compressed feed air in a vapour state into a higher pressure rectification column and separating the air into nitrogen vapour and oxygen-enriched liquid air;

condensing a flow of the nitrogen vapour;

separating a flow of the oxygen-enriched liquid air in a reboiled lower pressure rectification column into nitrogen-rich and oxygen-rich fractions;

employing a first flow of the condensed nitrogen as reflux in the higher pressure rectification column;

employing a second flow of the condensed nitrogen is employed as reflux in the lower pressure rectification column;

expanding a flow of compressed feed air with the performance of external work so as to create refrigeration for the process;

taking as products of the separation at least one of a gaseous nitrogen product from the higher pressure rectification column and a liquid nitrogen product;

a liquefying a second stream of compressed feed air;

a vaporizing at least a part of the liquefied second air stream at a pressure less than that at the top of the higher pressure rectification column by indirect heat exchange with a part of the said flow of nitrogen vapour; and warming, recompressing and mixing resulting vaporized air from said liquefied second air stream with feed air upstream of a location from where the first stream is taken.

2. The air separation process as claimed in claim 1, in which the warmed vaporised air is mixed with a flow of feed air upstream of being recompressed.

3. The air separation process as claimed in claim 1, in which a further liquefied air stream is introduced into one or both of the higher pressure rectification column and the lower pressure rectification column.

4. The air separation process as claimed in claim 1, in which the first stream of compressed feed air is formed at least in part of the flow of expanded feed air, said flow of expanded feed air being at a pressure at least equal to the pressure in the higher pressure rectification column.

5. The air separation process as claimed in claim 1, in which a part of the flow of the expanded feed air is warmed, is mixed with incoming air feed, and is recompressed therewith.

6. The air separation process as claimed in claim 5, in which incoming air feed is subjected to first and second stages of compression upstream of being purified and to at least one further stage of compression downstream of being purified, wherein the warmed, vaporised air stream is mixed with the incoming air feed intermediate the first and second stages of compression and the part of the flow of the expanded feed air that is warmed is mixed with the incoming air feed downstream of its purification.

7. The air separation process as claimed in claim 6, in which the flow of compressed feed air that is expanded is taken from downstream of the purification of the incoming air.

8. The air separation process as claimed in claim 6, in which the second stream of compressed air is taken from the most downstream of the compression stages.

9. The air separation process as claimed in claim 1, in which the said resulting vaporised air is warmed by indirect heat exchange with air flowing to the rectification column.

10. The air separation process as claimed in claim 1, in which an argon-enriched oxygen stream is withdrawn from the lower pressure rectification column and has an argon product separated therefrom in a further rectification column.

11. The air separation process as claimed in claim 1, in which an oxygen product is withdrawn from the lower pressure rectification column in liquid state and is vaporised by heat exchange with incoming air.

12. An air separation plant comprising:

a plurality of compression stages for compressing an air feed;

a higher pressure rectification column for separating air into nitrogen vapour and oxygen-enriched liquid air;

a first inlet for a first stream of compressed feed air in vapour state to the higher pressure rectification column;

a condenser associated with the higher pressure rectification column for condensing a flow of said nitrogen vapour;

a second inlet to the higher pressure rectification column for a reflux flow of part of the condensed nitrogen vapour;

an outlet from the higher pressure rectification column for a flow of the oxygen-enriched liquid air;

a lower pressure rectification column for separating the oxygen-enriched liquid air into nitrogen-rich and oxygen-rich fractions;

a first inlet to the lower pressure rectification column in communication with said outlet from the higher pressure rectification column;

a second inlet to the lower pressure rectification column for a reflux flow of another part of the condensed nitrogen vapour;

a reboiler associated with the lower pressure rectification column;

outlets from the plant for oxygen and nitrogen products including at least one of said outlets for a liquid nitrogen product or for a vaporous nitrogen product from the higher pressure rectification column;

at least one expansion turbine for expanding compressed feed air with the performance of external work;

means for liquefying a second stream of compressed air; and a vaporiser for vaporising at least a part of the liquefied second air stream at a pressure less than that pressure at the top of the higher pressure rectification column by indirect heat exchange with the part of the said flow of nitrogen vapour; and a heat exchanger for warming the resulting vaporised air;

one of the said compression stages having an inlet communicating with an outlet from said heat exchanger for the warmed, vaporised air.

13. An air separation plant comprising:

a plurality of compression stages for compressing an air feed;

a higher pressure rectification column for separating air into nitrogen vapour and oxygen-enriched liquid air;

a first inlet for a first stream of compressed feed air in vapour state to the higher pressure rectification column;

a condenser associated with the higher pressure rectification column for condensing a flow of said nitrogen vapour;

a second inlet to the higher pressure rectification column for a reflux flow of part of the condensed nitrogen vapour;

an outlet from the higher pressure rectification column for a flow of the oxygen-enriched liquid air;

a lower pressure rectification column for separating the oxygen-enriched liquid air into nitrogen-rich and oxygen-rich fractions;

a first inlet to the lower pressure rectification column in communication with said outlet from the higher pressure rectification column;

a second inlet to the lower pressure rectification column for a reflux flow of another part of the condensed nitrogen vapour;

a reboiler associated with the lower pressure rectification column;

outlets from the plant for oxygen and nitrogen products including at least one of said outlets for a liquid nitrogen product or for a vaporous nitrogen product from the higher pressure rectification column;

at least one expansion turbine for expanding compressed feed air with the performance of external work;

means for liquefying a second stream of compressed air;

a vaporiser for vaporising at least a part of the liquefied second air stream at a pressure less than that pressure at the top of the higher pressure rectification column by indirect heat exchange with the part of the said flow of nitrogen vapour; and a heat exchanger for warming the resulting vaporised air; and a dedicated compressor for recompressing the warmed, vaporised an inlet communicating with the outlet from said heat exchanger, for warmed, vaporised air and an outlet communicating with one of said compression stages.

14. The air separation plant as claimed in claim 12 or claim 13 wherein the higher pressure rectification column has a third inlet for a further stream of compressed air in liquid state.

15. The air separation plant as claimed in claim 12 or 13 in which the first inlet to the higher pressure rectification column communicates with an outlet of the said expansion turbine.

16. The air separation plant as claimed in claim 12 or 13 wherein an outlet of the said expansion turbine communicates with an inlet to one of the compression stages via said heat exchanger.

17. The air separation plant as claimed in claim 15 additionally including valve means for determining the proportions of turbine expanded air that, in use, are respectively introduced into the higher pressure rectification column through its first inlet and returned to said one of the compression stages.

18. The air separation plant as claimed in claim 17, additionally including an air purifier positioned downstream of first and second compression stages and upstream of at least one further compression stage and wherein the outlet from the second heat exchanger for the warmed, vaporised air communicating with an inlet to the second compression stage and the outlet from the said heat exchanger for the turbine expanded air communicates with the said further compression stage.

19. The air separation plant as claimed in claim 12 or claim 13, additionally including a further rectification column for separating an argon product from an argon-enriched oxygen stream withdrawn from the lower pressure rectification column.

* * * * *